US008739562B2

(12) United States Patent
Kohler et al.

(10) Patent No.: US 8,739,562 B2
(45) Date of Patent: Jun. 3, 2014

(54) SYSTEM FOR LIMITING PRESSURE DIFFERENCES IN DUAL COMPRESSOR CHILLERS

(75) Inventors: Jay A. Kohler, York, PA (US); Mark A. Adams, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 329 days.

(21) Appl. No.: 13/381,341

(22) PCT Filed: Jun. 9, 2010

(86) PCT No.: PCT/US2010/037926

§ 371 (c)(1),
(2), (4) Date: Dec. 28, 2011

(87) PCT Pub. No.: WO2011/008375

PCT Pub. Date: Jan. 20, 2011

(65) Prior Publication Data

US 2012/0111040 A1 May 10, 2012

Related U.S. Application Data

(60) Provisional application No. 61/221,130, filed on Jun. 29, 2009.

(51) Int. Cl.
*F25B 1/00* (2006.01)

(52) U.S. Cl.
USPC ..... 62/115; 62/498; 62/510

(58) Field of Classification Search
USPC ..... 62/115, 117, 119, 218, 498, 515
See application file for complete search history.

(56) References Cited

U.S. PATENT DOCUMENTS

| | | | | |
|---|---|---|---|---|
| 3,581,519 | A * | 6/1971 | Garrett et al. | 62/468 |
| 3,859,820 | A | 1/1975 | Dobney | |
| 4,467,613 | A * | 8/1984 | Behr et al. | 62/115 |
| 5,236,311 | A * | 8/1993 | Lindstrom | 417/254 |
| 5,996,356 | A | 12/1999 | Kishimoto et al. | |
| 7,584,624 | B2 * | 9/2009 | Hwang et al. | 62/192 |
| 2004/0037017 | A1 | 2/2004 | Lifson et al. | |
| 2008/0229782 | A1 * | 9/2008 | Takegami et al. | 62/513 |

FOREIGN PATENT DOCUMENTS

| | | |
|---|---|---|
| JP | H10132400 A | 5/1998 |
| WO | 9905463 | 2/1999 |

OTHER PUBLICATIONS

Korean Office Action for Korean Patent Application No. 10-2012-7002526 mailed Jul. 11, 2013.
International Search Report and Written Opinion of PCT Application No. PCT/US2010/037926 dated Nov. 26, 2010.

* cited by examiner

*Primary Examiner* — Melvin Jones
(74) *Attorney, Agent, or Firm* — Fletcher Yoder, P.C.

(57) ABSTRACT

Systems for limiting pressure differences in dual compressor chillers are provided. To achieve the efficiency benefits of series flow chillers within a single unit, an evaporator and/or a condenser may be partitioned into separate chambers by a baffle. Process fluid may then flow through one chamber of the evaporator and/or condenser prior to entering the other. This configuration creates a pressure differential between chambers which may reduce compressor head and result in greater chiller efficiency. However, to maintain the structural integrity of the evaporator and/or condenser baffle, a system for limiting this pressure differential may be employed. This system may include an evaporator pressure equalization valve, a common liquid line, or an equalizing line between separate liquid lines. Methods of operating dual compressor chillers using these systems are also provided.

20 Claims, 4 Drawing Sheets

SYSTEM FOR LIMITING PRESSURE DIFFERENCES IN DUAL COMPRESSOR CHILLERS

CROSS REFERENCE TO RELATED APPLICATIONS

This application claims priority from and the benefit of PCT Application Serial No. PCT/US2010/037926, entitled "System for Limiting Pressure Differences in Dual Compressor Chillers," filed Jun. 9, 2010, which is hereby incorporated by reference, and which claims priority from and the benefit of U.S. Provisional Application Ser. No. 61/221,130, entitled "System for Limiting Pressure Differences in Dual Compressor Chillers", filed Jun. 29, 2009, which is hereby incorporated by reference.

BACKGROUND

The invention relates generally to a system for limiting pressure differences in dual compressor chillers.

Certain refrigeration and air conditioning systems generally rely on a chiller to reduce the temperature of a process fluid, typically water. Air may then pass over this chilled process fluid in an air handler and circulate throughout a building. In typical chillers, the process fluid is cooled by an evaporator which absorbs heat from the process fluid through evaporating refrigerant. The refrigerant may then be compressed in a compressor and transferred to a condenser. In a liquid cooled condenser, the refrigerant is generally cooled by a second process fluid, causing the refrigerant to condense into a liquid. The liquid refrigerant may then be transferred back to the evaporator, to begin another refrigeration cycle.

Refrigeration system efficiency may be improved by linking multiple chillers together in a series flow configuration. In a dual chiller series flow arrangement, for example, the evaporator process fluid is circulated in series through two chillers. This configuration allows evaporator process fluid to be cooled in two discrete increments. Warmer process fluid enters the evaporator of the first or "lead" chiller and is cooled by an initial amount. Then, the cooler process fluid enters the evaporator of the second or "lag" chiller where its temperature is further reduced. Because the process fluid entering the lead evaporator is warmer, the lead evaporator will operate at a higher pressure compared to the lag evaporator. The higher evaporator pressure reduces compressor head, resulting in greater efficiency.

To further increase efficiency, process fluid from a cooling tower may circulate through two condensers. In this configuration, cooler process fluid first enters the condenser of the lag chiller. The process fluid is heated in this condenser before flowing to the condenser of the lead chiller. This arrangement is known as a counterflow configuration of the chillers and results in greater efficiency because the lead chiller has both a higher evaporator process fluid temperature and a higher condenser process fluid temperature. The higher temperatures result in higher pressures in both the evaporator and condenser of the lead chiller, thus reducing compressor head and yielding increased efficiency.

One disadvantage of series flow chillers is that they are typically more expensive because of the additional evaporator, condenser and conduits that must be installed. In addition, multiple chillers require a large amount of space, and some facilities may not be able to accommodate them. These constraints may preclude the use of series flow chillers and force facilities to adopt less efficient single chiller systems. Therefore, it would be advantageous for a single chiller to achieve the efficiency advantage of a series flow configuration.

SUMMARY

The present invention relates to a refrigeration system that includes a condenser which condenses a refrigerant. The refrigeration system also includes an evaporator which evaporates the refrigerant to extract heat from a process fluid. The evaporator is separated into first and second evaporator chambers by an evaporator baffle, where the first evaporator chamber operates at a first pressure during operation and the second evaporator chamber operates at a second pressure during operation. Furthermore, the refrigeration system includes a first compressor coupled to the first evaporator chamber for compressing vapor phase refrigerant for delivery to the condenser, and a second compressor coupled to the second evaporator chamber for compressing vapor phase refrigerant for delivery to the condenser. The refrigeration system also includes a means for limiting a difference between the first and second pressures.

The present invention also relates to a method of operating a dual compressor chiller that includes compressing refrigerant in a first compressor, where the first compressor is in fluid communication with a first chamber of a condenser. The method also includes condensing the refrigerant in the first chamber of the condenser, where the first chamber of the condenser is in fluid communication with a first chamber of an evaporator, and evaporating the refrigerant in the first chamber of the evaporator, where the first chamber of the evaporator is in fluid communication with the first compressor. Furthermore, the method includes compressing refrigerant in a second compressor, where the second compressor is in fluid communication with a second chamber of the condenser; condensing the refrigerant in the second chamber of the condenser, where the second chamber of the condenser is in fluid communication with a second chamber of the evaporator; and evaporating the refrigerant in the second chamber of the evaporator, where the second chamber of the evaporator is in fluid communication with the second compressor. The method also includes combining the refrigerant from the first chamber of the evaporator with the refrigerant from the second chamber of the evaporator.

DRAWINGS

DETAILED DESCRIPTION

Figure 1:
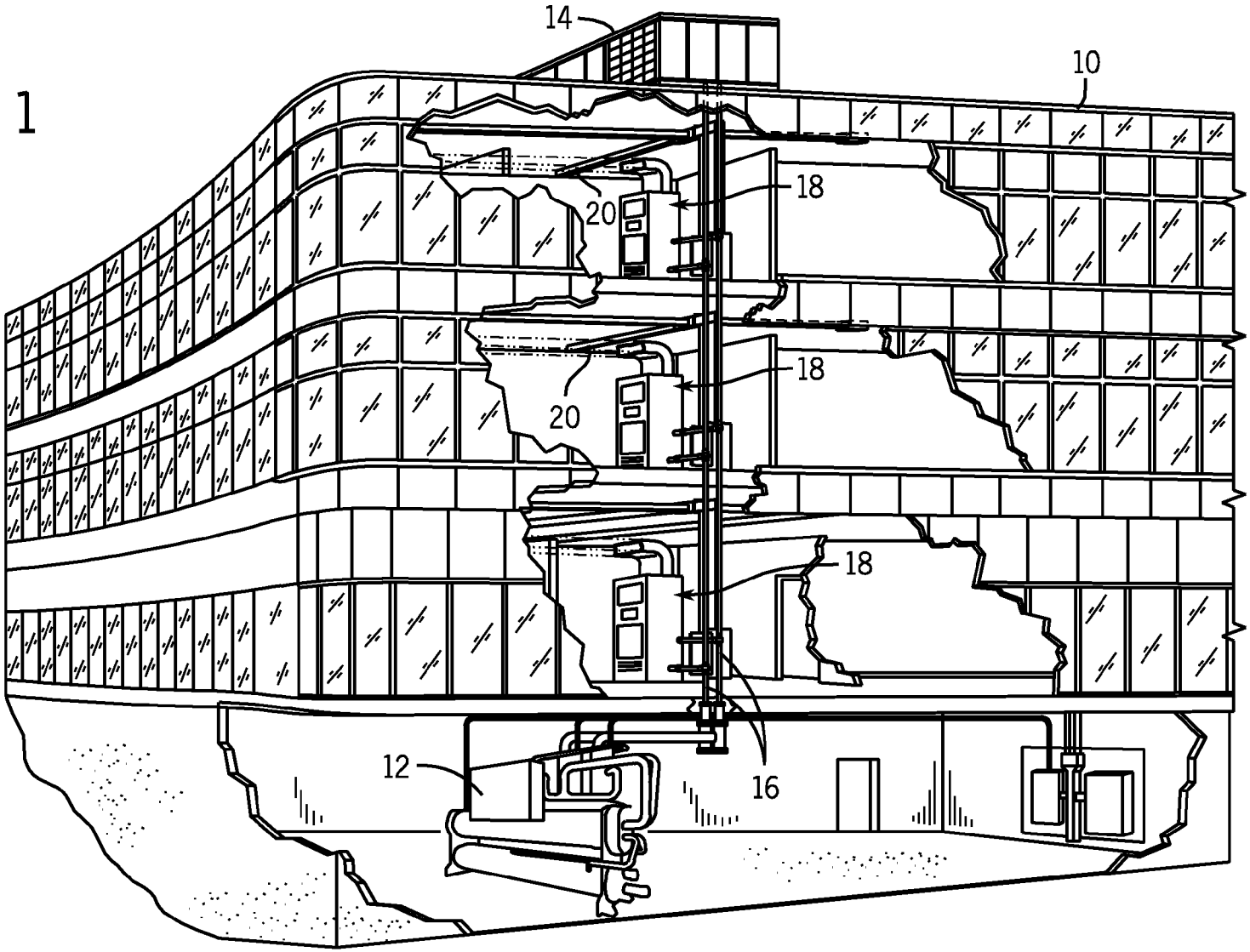
FIG. 1 is an illustration of an exemplary embodiment of a commercial HVAC system that employs a liquid cooled chiller.

FIG. 1 shows an exemplary application of a heating, ventilation and air conditioning (HVAC) system for building environmental management. In this embodiment, a building 10 is cooled by a refrigeration system. The refrigeration system may include a chiller 12 and a cooling tower 14. As shown, the chiller 12 is located in the basement and the cooling tower 14 is positioned on the roof. However, the chiller 12 may be located in other equipment rooms, and/or the cooling tower 14 may be situated next to the building 10. Chiller 12 may be a stand-alone unit or may be part of a single package unit containing other equipment, such as a blower and/or integrated air handler. Cold process fluid from the chiller 12 may be circulated through the building 10 by conduits 16. The conduits 16 are routed to air handlers 18, located on individual floors and within sections of the building 10.

Air handlers 18 are coupled to ductwork 20 that is adapted to distribute air between the air handlers and may receive air from an outside intake (not shown). Air handlers 18 include heat exchangers that circulate cold process fluid from the chiller 12 to provide cooled air. Fans within the air handlers 18 draw air through the heat exchangers and direct the conditioned air to environments within the building 10, such as rooms, apartments, or offices, to maintain the environments at a designated temperature. Other devices may, of course, be included in the system, such as control valves that regulate the flow of process fluid and pressure and/or temperature transducers or switches that sense the temperatures and pressures of the process fluid, the air, and so forth.

Figure 2:
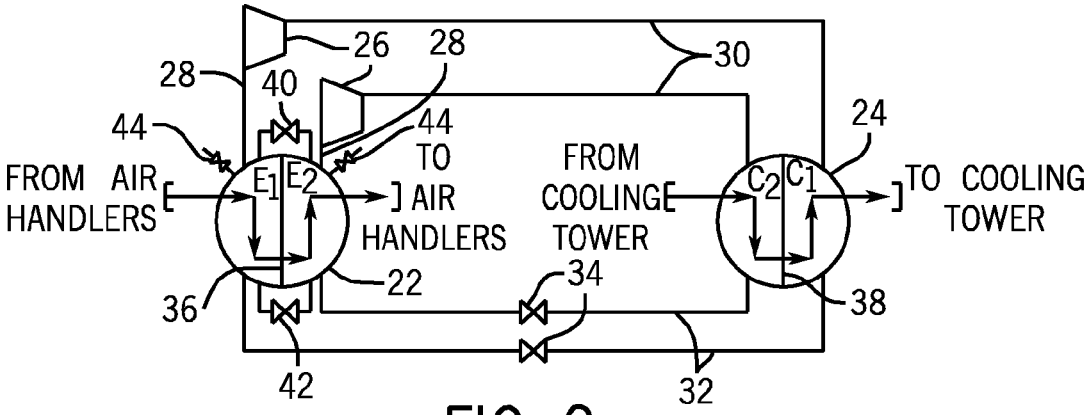
FIG. 2 is a block diagram of an exemplary liquid cooled chiller that employs a pressure equalization valve.

FIG. 2 is a block diagram of an exemplary chiller employing a pressure equalization valve. The chiller depicted in FIG. 2 has an evaporator 22, a condenser 24 and compressors 26. Refrigerant in a vapor phase exists the evaporator 22 and flows through suction lines 28 to the compressors 26. The refrigerant is then compressed within the compressors 26 and travels through discharge lines 30 to the condenser 24. The refrigerant is cooled within the condenser 24 by a process fluid supplied by a cooling tower. Within the condenser 24, heat is transferred from the refrigerant to the process fluid causing the process fluid to increase in temperature. This warm process fluid then travels back to the cooling tower where it is cooled by outside air. As the refrigerant cools, it condenses from a vapor to a liquid and then flows through liquid lines 32 to expansion devices 34, such as thermostatic expansion valves (TXV) or orifices. These expansion devices 34 control the pressure within the condenser 24 by restricting refrigerant flow through the liquid lines 32. The liquid refrigerant then flows into the evaporator 22 where a second process fluid is cooled by the evaporating refrigerant. As previously discussed, the chilled process fluid, typically water, flows to air handlers that cool air within a building.

The evaporator depicted in FIG. 2 is divided into two chambers by an evaporator baffle 36. Similarly, the condenser 24 is divided into two chambers by a condenser baffle 38. Each baffle, 36 and 38, forms a seal between the chambers which may prevent refrigerant flow from one chamber to the other. This seal may permit each chamber of the evaporator 22 and the condenser 24 to maintain different pressures. As depicted in FIG. 2, these chambers are components of two independent refrigerant circuits. The first circuit includes evaporator chamber E1 and condenser chamber C1. The second circuit includes evaporator chamber E2 and condenser chamber C2. In addition, each refrigerant circuit has an independent suction line 28, compressor 26, discharge line 30, liquid line 32 and expansion device 34.

These independent refrigerant circuits effectively permit the refrigeration system of the present embodiment to operate in a series flow configuration without the added complexity of multiple evaporators and condensers. For example, the first refrigerant circuit, including chambers E1 and C1, may operate at a higher temperature and pressure than the second refrigerant circuit, including chambers E2 and C2. In this configuration, the benefits of series flow may be obtained by chilling the process fluid in one chamber before it enters the second chamber. As depicted in FIG. 2, warm process fluid from the air handlers may enter evaporator chamber E1 first. As the refrigerant in chamber E1 evaporates, the process fluid is cooled. The process fluid may then enter chamber E2 where its temperature is further reduced. In this arrangement, evaporator chamber E1 may operate at a higher temperature than evaporator chamber E2 because process fluid entering chamber E1 is warmer than process fluid entering chamber E2. The higher operating temperature of chamber E1 may result in a higher chamber pressure. The process fluid flow pattern depicted in FIG. 2 is known as a two-pass configuration because process fluid flows through the evaporator 22 twice, once through each chamber.

Similarly, process fluid may flow through the condenser 24 in a two-pass configuration. For example, condenser chamber C1 may operate at a higher pressure than condenser chamber C2. As shown in FIG. 2, cool process fluid from the cooling tower may enter chamber C2 before it enters chamber C1. As the cool process fluid flows through chamber C2, heat is transferred from the refrigerant to the process fluid as the refrigerant condenses. This heat transfer results in an increased process fluid temperature. The warmer process fluid may then enter chamber C1 and extract heat from the condensing refrigerant within that chamber. Because the temperature of the process fluid entering chamber C1 is higher than the process fluid entering chamber C2, the refrigerant temperature in chamber C1 may be higher than the refrigerant temperature of chamber C2. As with the evaporator chambers, the higher temperature refrigerant may result in a higher operating pressure within chamber C1.

In the configuration depicted in FIG. 2, the advantages of a series flow system may be achieved with a single evaporator and a single condenser. Because both chambers E1 and C1 operate at a high pressure, the capacity of the compressor 26 linking these chambers is reduced because of a reduced pressure differential between the chambers. Similarly, the capacity of the compressor 26 linking chambers E2 and C2 may be reduced because both chambers operate at a lower pressure. Because each compressor 26 may operate at a reduced capacity, the efficiency of the refrigeration system may be greater than a similar system employing a single refrigerant circuit.

Both the evaporator baffle 36 and the condenser baffle 38 must maintain the pressure differential between the chambers of the evaporator 22 and the condenser 24. In other words, if the pressure difference between chambers exceeds the structural limits of the baffle, the baffle could fail. Therefore, a configuration may be employed that limits the pressure difference between refrigerant circuits.

One such configuration is depicted in FIG. 2. In this embodiment, a pressure equalization valve 40 may be employed to limit the pressure difference between chambers of the evaporator. The pressure equalization valve 40 may be in fluid communication with evaporator chambers E1 and E2. As illustrated, the valve 40 is directly coupled to chambers E1 and E2. In alternative embodiments, the valve 40 may be coupled to the suction lines 28 upstream of the evaporator 22. During nominal operation, this valve may remain closed to achieve the benefits of the dual refrigerant circuits described above. However, this valve may be opened either manually or by an automated system is response to an elevated pressure differential. For example, during normal operation of the refrigeration system, the pressure difference between the chambers E1 and E2 may be small because of the similar temperature of the process fluid within each chamber. However, during system maintenance, it may be necessary to remove the charge from one refrigerant circuit. If the pressure equalization valve 40 remained closed during this procedure, the pressure difference between the charged chamber and the uncharged chamber may become undesirably elevated. Therefore, the pressure equalization valve 40 may be opened in such situations to facilitate system repair without affecting the baffle.

Similarly, the refrigeration system shown in FIG. 2 may be configured such that one refrigerant circuit could operate while the other is deactivated. Operating in this configuration may be beneficial in situations where one compressor is inoperative because the system may continue operation at a lower capacity. In addition, where only a lower capacity is required, one compressor may be shut down to reduce power consumption of the refrigeration system. With one compressor not operating, a substantial pressure difference may be created between the chambers of both the evaporator 22 and the condenser 24. To compensate for the pressure difference, the pressure equalization valve 40 may be opened to allow refrigerant to flow from one circuit to the other. In addition, the expansion device 34 for the inoperative circuit may be closed to further facilitate mixing of the refrigerant.

To avoid large pressure differentials when the pressure equalization valve 40 is not opened, an internal pressure relief valve 42 may be activated. The internal pressure relief valve 42 may be configured to open automatically in response to a pressure differential between refrigerant circuits. For example, the internal pressure relief valve 42 may be coupled to the evaporator chambers E1 and E2. When the pressure difference between chambers E1 and E2 exceeds the desired level, the valve 42 may open automatically to equalize the pressure between chambers. When this valve opens, the efficiency benefit of series flow operation may be lost. However, when the pressure returns to a level that is within the desired limits, the valve 42 may automatically close, returning the system to normal operation.

In addition, external pressure relief valves 44 may also be employed. For example, FIG. 2 shows two pressure relief valves 44, one attached to each chamber of the evaporator 22. As the pressure within the evaporator 22 rises, the valves 44 may open to vent refrigerant. This venting may lower the pressure within the evaporator 22. In this configuration, because one external pressure relief valve 44 is employed for each chamber, each valve 44 may only be required to handle half of the total flow necessary to protect the evaporator 22. Also, the pressure required to open the external pressure relief valves 44 may be greater than the pressure required to open the internal pressure relief valve 42. In this arrangement, excessive refrigerant pressure in one chamber will first flow to the other chamber and then vent to the outside only when the higher pressure threshold is reached. A similar internal and external pressure relief system may be employed on the condenser 24 alone, or in combination with the evaporator 22 pressure relief system.

Figure 3:
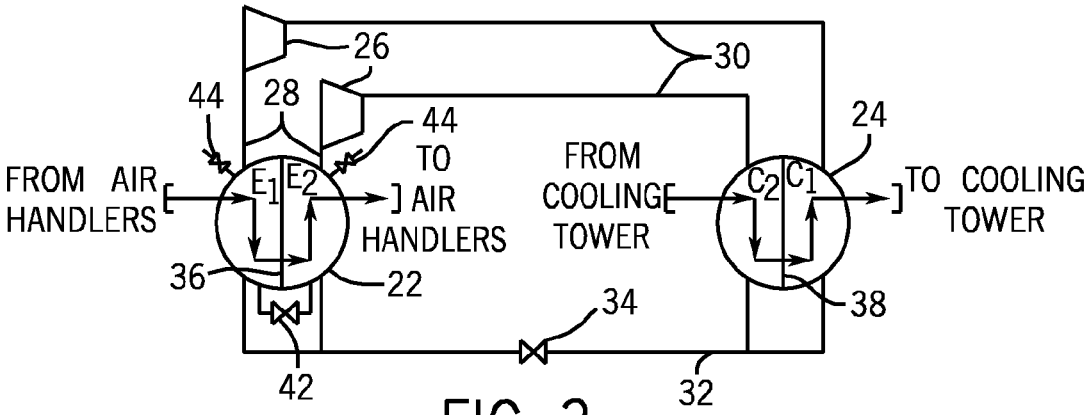
FIG. 3 is a block diagram of an exemplary liquid cooled chiller that employs a common liquid line.

FIG. 3 depicts another configuration that facilitates refrigerant flow from one circuit to another. This configuration includes a common liquid line 32 and common expansion device 34. Refrigerant may mix within these common components, thus limiting the pressure difference between refrigerant circuits. In this configuration, as refrigerant exits condenser chambers C1 and C2, the refrigerant mixes in the common liquid line 32 before entering the common expansion device 34. The mixed refrigerant then enters evaporator chambers E1 and E2.

In the flow arrangement depicted in FIG. 3, the condenser chambers and the evaporator chambers may be particularly configured to maintain the pressure difference between refrigerant circuits. If refrigerant was permitted to flow from the high pressure condenser chamber C1 to the low pressure condenser chamber C2 through the common liquid line 32, the benefits of series flow operation may be lost. Similarly, if the refrigerant from the high pressure evaporator chamber E1 was permitted to flow into the low pressure evaporator chamber E2, the efficiency of the system may be diminished. Therefore, both the evaporator 22 and condenser 24 may employ systems to maintain the pressure difference between chambers.

For example, the high pressure evaporator chamber E1 may employ a more restrictive liquid distributor than the low pressure evaporator chamber E2. The pressure of the evaporator chambers is essentially determined by the temperature of the process fluid that enters each chamber. In the configuration depicted in FIG. 3, warmer process fluid enters chamber E1 and cooler process fluid enters chamber E2. Therefore, the pressure within chamber E1 may be greater than the pressure within chamber E2. If the liquid distributors within each chamber were equally restrictive, more refrigerant from the common liquid line 32 would enter the low pressure chamber E2. This refrigerant flow may lead to an imbalance of refrigerant within the system, resulting in decreased efficiency. By configuring the liquid distributor within the low pressure evaporator chamber E2 to be more restrictive than the liquid distributor within the high pressure evaporator chamber E1, an equal volume of refrigerant may enter each chamber despite the pressure difference. For a given liquid distributor configuration, only one refrigerant pressure would ensure equal refrigerant flow into both evaporator chambers. However, if the liquid distributors are adjusted to provide equal flow for the nominal operating pressure, slight variations from this condition may only have a small impact on the efficiency of the refrigeration system.

Similarly, the condenser chambers may be configured to expel similar amounts of refrigerant into the common liquid line 32, despite operating at different pressures. As with the evaporator 22, the pressure within a condenser chamber is determined by the temperature of the process fluid entering the chamber. For example, the configuration depicted in FIG. 3 shows cooler process fluid from the cooling tower entering the condenser chamber C2. The process fluid is heated within chamber C2 and becomes warmer before entering chamber C1. Therefore, the pressure within chamber C1 may be greater than the pressure within chamber C2. Without any condenser chamber flow restriction, more refrigerant may be expelled by the high pressure chamber C1. Therefore, the high pressure chamber C1 may be configured to have a greater flow restriction than the low pressure chamber C2. This arrangement may be accomplished by varying the flow of refrigerant through subcoolers within each condenser chamber. A subcooler is a region of the condenser 24 in which the temperature of refrigerant is further reduced after it has been condensed. By restricting the flow of liquid refrigerant through the subcooler, the amount of refrigerant expelled by the high pressure chamber C1 may be reduced. For example, the subcooler within the high pressure condenser chamber C1 may be configured to expel the same volume of refrigerant as the low pressure condenser chamber C2. In this manner, the volume of refrigerant entering the common liquid line 32 may be the same for both chambers of the condenser 24. However, as with the evaporator 22, this configuration may only be completely effective for one condenser pressure. Therefore, the subcoolers may be configured to expel equal amounts of refrigerant at the nominal operating condition.

Figure 4:
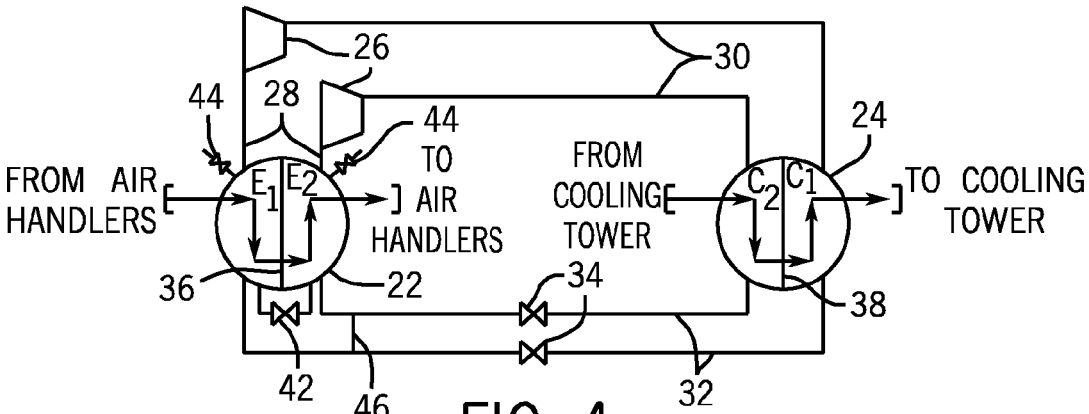
FIG. 4 is a block diagram of an exemplary liquid cooled chiller that employs an equalizing line.

FIG. 4 depicts a similar embodiment in which two liquid lines 32 and two expansion devices 34 are employed, but an equalizing line 46 connects the two liquid lines 32 downstream of the expansion devices 34. In this configuration, different subcooler restrictions for each condenser chamber may not be necessary because the expansion devices 34 could be adjusted to control liquid refrigerant flow out of the condenser chambers. For example, if condenser chamber C1 is operating at a higher pressure than condenser chamber C2, the expansion device 34 coupled to the liquid line 32 exiting chamber C1 may be more restrictive than the expansion device 34 coupled to the liquid line 32 exiting chamber C2. Similar to the subcooler restrictions of the previous embodiment, this configuration may facilitate an equal volume of refrigerant entering the liquid lines 32 downstream of the expansion devices 34. In addition, pressure within the system may be limited by allowing refrigerant to flow between liquid lines 32 through the equalizing line 46. One advantage of the present embodiment is that the flow rate through the expansion devices 34 could be varied based on the pressure of the condenser chambers. Therefore, an equal amount of refrigerant may enter the liquid lines 32 downstream of the expansion devices 34 for off-nominal operating conditions.

In each of the embodiments presented in FIGS. 2 through 4, both the evaporator 22 and the condenser 24 are divided into two chambers. However, other configurations may employ a single evaporator chamber or a single condenser chamber, i.e., no baffle separating the chambers. For example, where a high process fluid flow rate through the condenser 24 is desired, a single-pass configuration may be preferable to the two-pass arrangement depicted in FIGS. 2 through 4. In such a configuration, a single condenser chamber may be employed. Because refrigerant may be allowed to mix within this single condenser chamber, the pressure equalization valve 40 depicted in FIG. 2 or the equalizing line 46 shown in FIG. 4 may not be necessary to facilitate pressure differential limiting. In such a configuration, a common liquid line 32 or separate liquid lines 32 may be employed. However, as previously described, the liquid distributor within the low pressure evaporator chamber E2 may be more restrictive than the liquid distributor within the high pressure evaporator chamber E1 to maintain a pressure difference between chambers.

Similarly, certain embodiments may employ a single evaporator chamber. These embodiments may utilize a common liquid line 32 or dual liquid lines 32, but may not require a pressure equalization valve 40 or an equalizing line 46 to limit the pressure differential between condenser chambers. To maintain the pressure difference between condenser chambers, the condenser 24 may employ subcoolers with different flow restrictions.

In embodiments with two condenser chambers, a second pressure equalization valve (not shown) may be coupled to each condenser chamber. In certain embodiments, refrigerant may be isolated in the condenser 24 such that repairs may be conducted on the compressors 26 without requiring draining of refrigerant from the entire system. However, with refrigerant isolated in the condenser 24, the previously described pressure equalization systems may be ineffective. Therefore, the second pressure equalization valve could be opened to relieve pressure on the condenser baffle 38.

Figure 5:
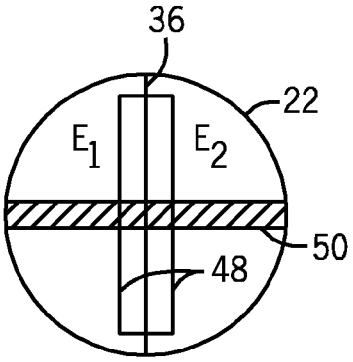
FIG. 5 is a cross-sectional view of an exemplary evaporator that may be used in the chillers shown in FIGS. 2 through 4, in which a baffle is supported by ribs and reinforcing bars.
Figure 6:
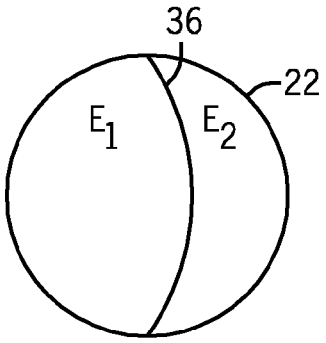
FIG. 6 is a cross-sectional view of an exemplary evaporator that may be used in the chillers shown in FIGS. 2 through 4, employing a curved baffle.
Figure 7:
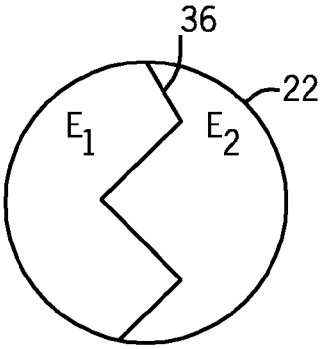
FIG. 7 is a cross-sectional view of an exemplary evaporator that may be used in the chillers shown in FIGS. 2 through 4, employing a zigzag baffle.

FIGS. 5 through 7 present front views of the evaporator 22, showing various baffle configurations. While the figures depict evaporator baffles 36, the designs may be employed for condenser baffles 38 as well. As previously discussed, the baffle serves as a barrier between chambers to allow each chamber to operate at a different pressure. Therefore, the baffle may be configured to resist this pressure difference during operation. One embodiment which may support the baffle is shown in FIG. 5. In this configuration, baffle support ribs 48 may be coupled to the baffle 36 to increase its stiffness. For example, if the pressure within chamber E1 is greater than the pressure within chamber E2, the baffle 36 may tend to deform toward chamber E2. The ribs 48 may help to prevent this deformation by providing additional structural support. While only two ribs 48 are illustrated in FIG. 5, additional ribs may be coupled to the baffle 36, such as along the longitudinal axis of the evaporator 22. The number of ribs, the spacing of ribs and the attachment points of these ribs may vary based on the particular baffle design. Similarly, a baffle reinforcing bar 50 may be coupled to the baffle 36 and the inner walls of the evaporator 22. This reinforcing bar 50 may further support the baffle 36 and prevent deformation. The thickness of the reinforcing bar 50 may vary based on the baffle design. In addition, multiple reinforcing bars may be employed down the longitudinal axis of the evaporator 22.

FIG. 6 shows another baffle design that may increase structural rigidity. The baffle 36 in this configuration is curved. For example, if the pressure in chamber E1 is greater than the pressure in chamber E2, the baffle 36 may be curved in the direction of chamber E2. As will be appreciated by those skilled in the art, a curved surface may be able to resist higher pressure than a flat surface. By curving the baffle 36 in the direction of the low pressure chamber E2, the baffle 36 may be able to support a greater pressure within the high pressure chamber E1. Similarly, the baffle 36 depicted in FIG. 7 is configured in a zigzag pattern. As will be appreciated by those skilled in the art, this configuration may provide greater structural rigidity than a flat baffle. Both of these configurations may allow a greater pressure difference between chambers because of the increased baffle strength. As previously discussed, this pressure difference may yield increased efficiency of the refrigeration system.

Figure 8:
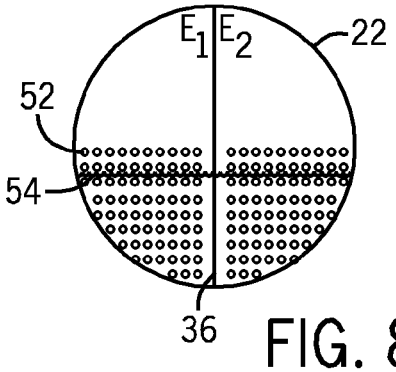
FIG. 8 is a cross-sectional view of an exemplary flooded evaporator that may be used in the chillers shown in FIGS. 2 through 4.
Figure 9:
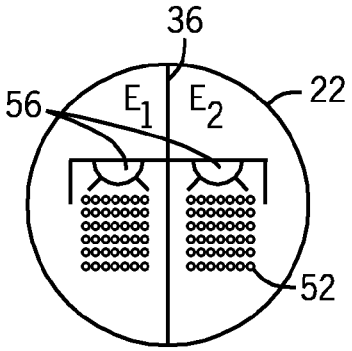
FIG. 9 is a cross-sectional view of an exemplary falling film evaporator that may be used in the chillers shown in FIGS. 2 through 4.

FIGS. 8 and 9 present two evaporator configurations that may be employed in the above embodiments. FIG. 8 depicts a front view of a flooded evaporator. In this configuration, a number of conduits 52 carrying process fluid are located within the evaporator 22 and run along its longitudinal axis. As liquid refrigerant 54 within each evaporator chamber evaporates, the temperature of the process fluid may be reduced. Therefore, process fluid exiting each evaporator chamber may be at a lower temperature than when it entered the respective chamber. The size and number of conduits 52 within the evaporator 22 may vary based on evaporator requirements. In addition, the size and number of conduits 52 in chamber E1 may be different than chamber E2.

FIG. 9 depicts a front view of an alternative evaporator configuration known as a falling film evaporator. In this configuration, liquid refrigerant is sprayed onto the process fluid conduits 52 by nozzles 56. Similar to the flooded evaporator, as the refrigerant evaporates, the process fluid within the conduits 52 may be cooled.

Figure 10:
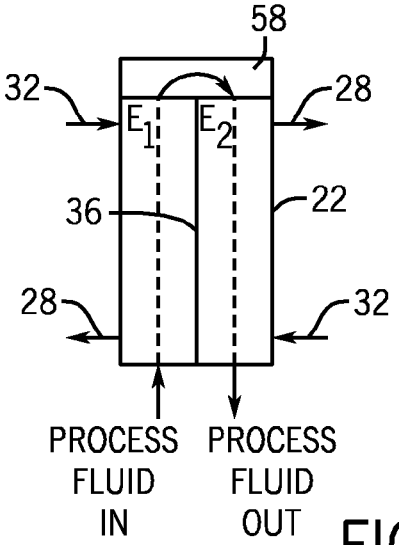
FIG. 10 is a block diagram of an exemplary counterflow evaporator that may be used in the chillers shown in FIGS. 2 through 4.

FIG. 10 is a diagrammatical view of the previously discussed counterflow configuration of the evaporator 22. In this configuration, refrigerant enters evaporator chamber E1 through liquid line 32 and flows through the chamber to suction line 28. Similarly, refrigerant flows into chamber E2 through liquid line 32 and up to suction line 28. In each chamber, the process fluid flows in the opposite direction of the refrigerant. In the embodiment depicted in FIG. 10, chamber E1 is operating at a higher temperature and pressure than chamber E2. Warm process fluid enters chamber E1 first, where it flows in the opposite direction of the refrigerant and is cooled by a first amount. The process fluid then changes direction in a water box 58 and enters chamber E2, where it is cooled by a second amount. Because warmer fluid enters chamber E1, chamber E1 operates at a higher temperature and pressure. This configuration allows the temperature of the process fluid to be lowered in two stages, increasing the efficiency of the refrigeration system.

The process fluid flow pattern depicted in FIG. 10 represents a two-pass flow configuration. Additional flow patterns may be implemented in other embodiments of the present invention. For example, the evaporator may employ a four-pass flow configuration. Similar to the arrangement shown in FIG. 10, process fluid may enter chamber E1 at a first end of the evaporator 22 and flow to a second end. However, instead of flowing to chamber E2 through the water box 58, the process fluid is directed back into chamber E1 where it flows in the opposite direction. At that point, the process fluid may be directed into chamber E2 through a water box at the first end of the evaporator 22, and flow through chamber E2 to the second end. Finally, the process fluid may be redirected back through chamber E2, exiting the first end of the evaporator 22. In this manner, the process fluid flows through each chamber twice, for a total of four passes. The two-pass and four-pass configurations are only exemplary flow patterns that may be implemented to transfer heat from refrigerant to process fluid in the evaporator 22. These and other configurations may be employed based on the particular design requirements of the refrigeration system.

Figure 11:
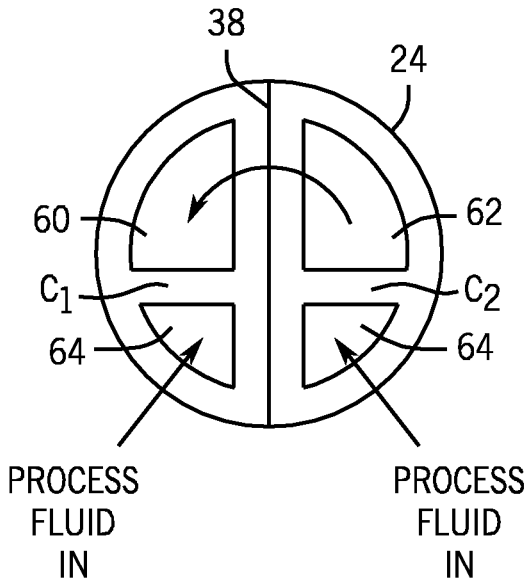
FIG. 11 is a front cross-sectional view of an exemplary condenser that may be used in the chillers shown in FIGS. 2 through 4.
Figure 12:
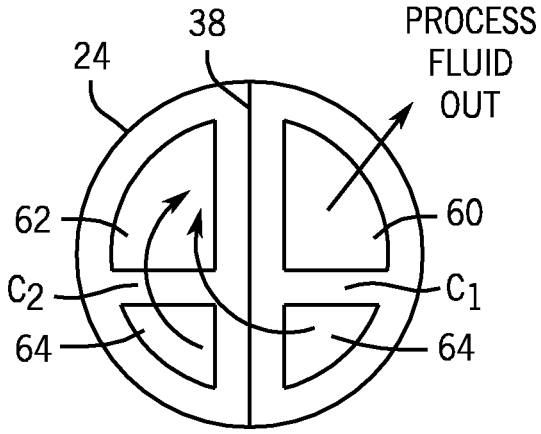
FIG. 12 is a back cross-sectional view of an exemplary condenser that may be used in the chillers shown in FIGS. 2 through 4.

FIGS. 11 and 12 show an exemplary configuration of a condenser 24 that may be employed in the above embodiments. FIG. 11 shows a front view of a condenser 24 that includes a first condensing region 60, a second condensing region 62, and two subcooling regions 64. FIG. 12 presents a back view of the same exemplary condenser 24. In the configuration depicted in these figures, cool process fluid from a cooling tower may enter the condenser 24 through the two subcooling regions 64. As depicted in FIG. 12, the process fluid exists these subcooling regions 64 and enters the second condensing region 62. This transfer of fluid causes the direction of fluid flow to reverse within the second condensing region 62. The process fluid then exists the second condensing region 62 and enters the first condensing region 60, as depicted in FIG. 11. Similar to the previous fluid transfer, this transfer results in another change in process fluid direction. Finally, as shown in FIG. 12, the process fluid exits the condenser 24 through the first condensing region 60 and returns to the cooling tower.

Because the process fluid is coolest when it enters the subcoolers 64, the subcoolers 64 operate at the lowest temperature. Within the subcoolers 64, the process fluid temperature increases as heat is transferred from refrigerant within the subcoolers 64 to the process fluid. Therefore, when the process fluid enters the second condensing region 62, it is warmer than when it entered the subcoolers 64. Similarly, when the process fluid enters the first condensing region 60, it is warmer than when it entered the second condensing region 62. This configuration may increase refrigeration system efficiency because maximum refrigerant temperature reduction is achieved for both chambers of the condenser 24 due to the low temperature subcoolers 64. Furthermore, the higher temperature of the first condensing region 60 enables chamber C1 to operate at a higher pressure than chamber C2, which contains the cooler second condensing region 62. As previously discussed, this pressure differential reduces compressor head and increases efficiency.

The process fluid flow pattern depicted in FIGS. 11 and 12 represent a three-pass configuration. Other flow configurations may also be implemented within the condenser 24. For example, in a four-pass configuration, process fluid may enter the subcooling region of chamber C2 from a first end of the condenser 24. The process fluid may then flow to a second end of the condenser 24, and be redirected into the second condensing region 62. At that point, the process fluid may be redirected into the subcooling region of chamber C1 at the first end of the condenser 24. The process fluid may flow to the second end where it is redirected into the first condensing region 60. Finally, the process fluid may then exit the second end of the condenser 24 through the first condensing region 60. In this manner, the process fluid flows through each chamber twice, for a total of four passes. Other four-pass arrangements may also be employed.

In addition, a two-pass arrangement similar to the one described in FIG. 10 with regard to the evaporator 22 may be implemented for the condenser 24. In this configuration, process fluid may enter chamber C2 at a first end of the condenser 24, flow to the second end and be redirected into chamber C1 through a water box. The process fluid may then flow back to the first end of the condenser 24 through chamber C1, and exit the condenser 24. The flow patterns described above, among others, may be selected based on particular design requirements of the condenser.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigeration system comprising:

a condenser configured to condense a refrigerant;

an evaporator configured to evaporate the refrigerant to extract heat from a process fluid, the evaporator being separated into first and second evaporator chambers by an evaporator baffle, the first evaporator chamber operating at a first pressure during operation and the second evaporator chamber operating at a second pressure during operation;

a first compressor coupled to the first evaporator chamber for compressing vapor phase refrigerant for delivery to the condenser;

a second compressor coupled to the second evaporator chamber for compressing vapor phase refrigerant for delivery to the condenser; and means for limiting a difference between the first and second pressures, wherein the means for limiting the difference between the first and second pressures comprises a pressure equalizing conduit in fluid communication between refrigerant conduits upstream of the evaporator.

2. The system of claim 1, wherein the condenser includes first and second condenser chambers separated from one another by a condenser baffle, the first and second condenser chambers operating at different pressures during operation, and wherein the first evaporator chamber is in fluid communication with the first condenser chamber via the first compressor, and the second evaporator chamber is in fluid communication with the second condenser chamber via the second compressor.

3. The system of claim 2, comprising means for limiting a difference in pressure between the first and second condenser chambers.

4. The system of claim 3, wherein the condenser is a two-pass heat exchanger including a first process fluid pass in the first condenser chamber, and a second process fluid pass in the second condenser chamber.

5. The system of claim 3, wherein each of the first and second condenser chambers is subdivided into respective condensing and subcooling sections, and wherein the condensing and subcooling sections are configured to define a multi-pass heat exchanger in which a second process fluid flows in parallel through the subcooling section of the first and second condenser chambers, is then combined, then flows through the condensing section of the first chamber, and then through the condensing section of the second chamber.

6. The system of claim 1, wherein the evaporator is a two-pass heat exchanger including a first process fluid pass in the first evaporator chamber, and a second process fluid pass in the second evaporator chamber.

7. The system of claim 1, wherein the pressure equalizing conduit comprises an internal pressure relief valve in fluid communication between the first and second evaporator chambers, wherein the internal pressure relief valve is configured to open automatically in response to a pressure differential between the first evaporator chamber and the second evaporator chamber.

8. The system of claim 1, wherein the pressure equalizing conduit comprises a common refrigerant conduit upstream of the evaporator, and wherein the common refrigerant conduit is in fluid communication with a first chamber of the condenser, a second chamber of the condenser, the first evaporator chamber, and the second evaporator chamber.

9. A refrigeration system comprising:

a condenser having a condenser baffle separating a first condenser chamber and a second condenser chamber;

an evaporator having an evaporator baffle separating a first evaporator chamber and a second evaporator chamber, wherein the first evaporator chamber is in fluid communication with the first condenser chamber, and the second evaporator chamber is in fluid communication with the second condenser chamber;

a first compressor in fluid communication with the first condenser chamber and the first evaporator chamber;

a second compressor in fluid communication with the second condenser chamber and the second evaporator chamber;

wherein the first condenser chamber, the first evaporator chamber and the first compressor comprise a first refrigerant circuit, and the second condenser chamber, the second evaporator chamber and the second compressor comprise a second refrigerant circuit, the first refrigerant circuit being configured to operate at first pressures and temperatures, and the second refrigerant circuit being configured to operate at second pressures and temperatures higher than the first pressures and temperatures;

and further comprising a refrigerant interconnect in fluid communication between the first and second refrigerant circuits and configured to limit a pressure difference between the first and second pressures.

10. The system of claim 9, comprising an internal pressure relief valve in fluid communication with the first evaporator chamber and the second evaporator chamber, and configured to open when the pressure difference between the first evaporator chamber and the second evaporator chamber exceeds a predetermined value.

11. The system of claim 9, comprising one or more external pressure relief valves configured to vent refrigerant when the refrigerant pressure exceeds a predetermined value.

12. The system of claim 9, wherein the refrigerant interconnect comprises a pressure equalization valve in fluid communication with the first evaporator chamber and the second evaporator chamber.

13. The system of claim 9, wherein the refrigerant interconnect comprises a common liquid line in fluid communication with the first evaporator chamber, the second evaporator chamber, the first condenser chamber, and the second condenser chamber.

14. The system of claim 9, wherein the refrigerant interconnect comprises:

a first liquid line connecting the first evaporator chamber to the first condenser chamber;

a second liquid line connecting the second evaporator chamber to the second condenser chamber; and an equalizing line connecting the first liquid line to the second liquid line.

15. The system of claim 9, wherein the evaporator baffle, the condenser baffle, or a combination thereof is curved or forms a zigzag pattern.

16. The system of claim 9, wherein the evaporator baffle, the condenser baffle, or a combination thereof comprises at least one baffle support rib, at least one baffle reinforcing bar, or a combination thereof.

17. A method of operating a dual compressor chiller comprising:

compressing refrigerant in a first compressor, the first compressor being in fluid communication with a first chamber of a condenser;

condensing the refrigerant in the first chamber of the condenser, the first chamber of the condenser being in fluid communication with a first chamber of an evaporator;

evaporating the refrigerant in the first chamber of the evaporator, the first chamber of the evaporator being in fluid communication with the first compressor;

compressing refrigerant in a second compressor, the second compressor being in fluid communication with a second chamber of the condenser;

condensing the refrigerant in the second chamber of the condenser, the second chamber of the condenser being in fluid communication with a second chamber of the evaporator;

evaporating the refrigerant in the second chamber of the evaporator, the second chamber of the evaporator being in fluid communication with the second compressor; and combining the refrigerant from the first chamber of the evaporator with the refrigerant from the second chamber of the evaporator.

18. The method of claim 17, wherein the combining the refrigerant comprises opening a pressure equalization valve, the pressure equalization valve being in fluid communication with the first chamber of the evaporator and the second chamber of the evaporator.

19. The method of claim 17, wherein the combining the refrigerant comprises mixing the refrigerant in a common liquid line, the common liquid line being in fluid communication with the first chamber of the condenser, the second chamber of the condenser, the first chamber of the evaporator and the second chamber of the evaporator.

20. The method of claim 17, wherein the combining the refrigerant comprises mixing the refrigerant in an equalizing line, the equalizing line being in fluid communication with a first and a second liquid line, the first liquid line being in fluid communication with the first chamber of the condenser and the first chamber of the evaporator, the second liquid line being in fluid communication with the second chamber of the condenser and the second chamber of the evaporator.

* * * * *